US011554508B2

(12) United States Patent
Nicaise

(10) Patent No.: US 11,554,508 B2
(45) Date of Patent: Jan. 17, 2023

(54) FOLDING KNIFE

(71) Applicant: Michel Nicaise, Grez-Doiceau (BE)

(72) Inventor: Michel Nicaise, Grez-Doiceau (BE)

( * ) Notice: Subject to any disclaimer, the term of this patent is extended or adjusted under 35 U.S.C. 154(b) by 326 days.

(21) Appl. No.: 16/678,114

(22) Filed: Nov. 8, 2019

(65) Prior Publication Data

US 2020/0391395 A1 Dec. 17, 2020

(30) Foreign Application Priority Data

Jun. 14, 2019 (LU) ..... 101269

(51) Int. Cl.
*B26B 1/04* (2006.01)

(52) U.S. Cl.
CPC ..... *B26B 1/048* (2013.01)

(58) Field of Classification Search
CPC .. B26B 1/02; B26B 1/04; B26B 1/048; B26B 1/08
See application file for complete search history.

(56) References Cited

U.S. PATENT DOCUMENTS 2,774,139 A * 12/1956 Polk ..... B26B 1/048 30/161
5,029,354 A * 7/1991 Boyd, Jr. ..... B26B 1/048 7/118
5,131,149 A 7/1992 Thompson et al.
5,647,129 A 7/1997 Stamper
6,158,127 A * 12/2000 Taylor ..... B26B 1/02 30/158
7,581,321 B2 * 9/2009 Kain ..... B26B 1/048 30/153
9,186,801 B1 11/2015 Steigerwalt
2010/0242288 A1 * 9/2010 Onion ..... B26B 1/02 30/160

* cited by examiner

*Primary Examiner* — Stephen Choi
(74) *Attorney, Agent, or Firm* — Maier & Maier, PLLC

(57) ABSTRACT

A folding knife including a handle with a liner block with two parallel liners, defining a storage space between them. A blade pivotably mounted on the liner block with a pivoting axis engaged through the base of the blade and mounted on the liner block so that the blade can pivot between an inactive position, in which the blade is received in the storage space in the liner block, and an active position, in which the blade extends in line with the handle. A blade lock capable of blocking the blade in the active position.

20 Claims, 8 Drawing Sheets

FOLDING KNIFE

FIELD

This invention is generally related to the field of folding knives. In particular, it is related to a folding knife equipped with a blade locking system when it is open, and which has a blade that is longer than the handle.

BACKGROUND

As we know, folding knives are knives whose blade can be folded away into the handle when the knife is not being used.

A classic folding knife comprises a blade which is hinged on the handle by means of a pivot. The handle generally has a pair of parallel liners joined on one edge by one or several spacers, defining a storage space for the blade, with the pivot being fixed to the liners.

Herein below, reference is made to the active and inactive positions, which are the positions taken by the blade relative to the liners when the knife is open (active position) and when the knife is closed (inactive position). Typically, in the active position, the blade extends out of the liners in line with the handle, whereas in the inactive position the blade is received between the liners, inside of the handle.

Those skilled in the art who wish to manufacture a knife must make a number of considerations which will impact the use and ergonomics of the knife.

We can firstly mention the locking mechanism. Indeed, it is generally desirable for the folding knife to be equipped with means to keep the blade in, at least, an active position. For this purpose, there are different mechanisms available, which are built and/or used with different degrees of ease.

A very popular system which locks the blade in the active position is called a "liner lock". One of the liners has a cut portion which acts as a spring. When the blade is in the active position, it takes place against the heel of the blade to ensure efficient locking. The blade is unlocked by disengaging the liner lock using the thumb.

Unlike other systems such as slip joints, some back locks, or collar locks, the liner lock is interesting because it does not require a significant force to pivot the blade out of its inactive position. In general, it is simply held in place by a detent ball.

Another thing to consider is the size of the blade, respectively of the knife. For some uses, for example hunting, a large blade may be desirable. Typically, for a folding knife, an increase in the length of the blade implies a corresponding increase in the length of the handle where the blade must be stored. But a long handle may be detrimental to the handling and manoeuvrability of the knife.

In this connection, folding knives with a blade longer than the handle do still exist. One can first mention so-called "à la d'Estaing" knives, whose additional blade length simply sticks out the back of the handle when the knife is closed/folded. It therefore requires the use of a sheath which covers the blade.

The U.S. Pat. Nos. 5,647,129 and 9,186,801 describe folding knives having a blade longer than the handle. The handle includes an accessory which is deployed in the blade's inactive position, in order to cover the edge of the blade which sticks out the back of the handle body.

Still with regards to ergonomics, some cutlery manufacturers have proposed mechanisms which allow opening using one hand, whether automatically (e.g. assisted by a spring) or manually.

We can mention here, for example, U.S. Pat. No. 5,131,149, which comprises a hollow rectangular handle with a longitudinal gap along one of its edges and a blade support, upon which the blade pivots, slidably mounted inside this handle. To open, the grooved heel of the blade is moved away from the handle by pushing the support, pivoting the blade with the thumb, and returning back the heel of the blade into the handle by sliding again the support. The blade being entirely held in the handle when closed, this unusual mechanism is uniquely adapted for knives whose blade is shorter than the handle.

SUMMARY

This invention aims to provide a folding knife with an improved design which is specially adapted for a blade which is longer than the handle.

In accordance with the present disclosure, a folding knife includes:

a handle including a liner block, the handle extending in a longitudinal direction and the liner block comprising two parallel liners defining a storage space between them;

a blade pivotably mounted on the liner block by means of a pivoting axis through the base (also referred as heel) of the blade and mounted on the liner block so that the blade can pivot between an inactive position, in which the blade is received in the storage space in the liner block, and an active position, where the blade extends in line with the handle (in axial continuation therewith); and a blade lock capable of blocking the blade in the active position.

The knife is remarkable in that the liner block is mounted in the handle to be slidable substantially in the longitudinal direction between:

a distal position, corresponding to a closed configuration of the knife with the blade in the inactive position, in which the liner block is offset relative to the handle such that a front section of the liner block is at a distance from the handle, thus freeing up a space with a corresponding length in the handle for the blade to enter into, the blade being thus received into the liner block and the handle; and a proximal position, corresponding to an open configuration of the folding knife with the blade in the active position and locked by the blade lock, wherein the front section of the liner block is in a proximal position to the handle, taking up the space that is free in the distal position.

Furthermore, a handle lock is provided to lock the liner block with regards to the handle in the proximal position.

The knife according to the present invention thus employs an articulated assembly of three distinct elements: the blade, the liner block and the handle.

The blade pivots between the liners, which slide into the handle. A traditional folding knife is comprised of two elements only: the blade and the handle. When it is closed, the blade folds away into the handle, whose length depends on that of the blade.

The present invention, which uses a principle of sliding liners, is therefore freed from this limitation.

It will be noticed that, when the knife is closed, the liner block is in a distal position, in other words it partially slides away from the knife (out of the handle) to free up space in the handle, which the front part of the blade with the point goes into. In the inventive concept, the excess length of the blade therefore goes into, when in the inactive position, the part of the liner block which is outside the handle, the point of the blade (the most dangerous part) being inside the handle. This contrasts with solutions as disclosed in U.S.

Pat. No. 5,647,129, where the point of the blade sticks out from the handle, being covered by the accessory.

As used herein, the term "blade length" means the visible length of the blade, with the knife open and ready to use (i.e. the blade is active and the liner block is in the proximal position).

This folding knife has been developed to be used with blades which are longer than (or equal in length to) the handle, but the inventive concept is equally applicable when the blade length is shorter than that of the handle. Indeed, given that the pivoting point of the blade is located on the heel of the blade, the actual length of the blade (point to heel) is longer than the visible length of the open knife blade. The inventive concept is also of interest for blades which have a visible blade length that is shorter than that of the handle.

In embodiments, the opening manoeuvre (and conversely the closure) of the blade involves a rotation and a translation, which may be combined or done one after the other.

Advantageously, the knife is designed so that the blade can be pivoted away from the handle from the inactive position. The blade can be pivoted away from the handle by holding it, or using a thumb stud or protrusion (flipper), or even through inertia caused by a movement of the wrist.

In the closed configuration of the knife, with the liner block in the distal position, the pivoting axis is located outside of the handle, spaced away from the front edge of the handle body. In the opening position, the liner block is in the proximal position, and the pivoting axis is therefore brought back towards the handle. In this position, the head of the pivoting axis may be in abutment against the handle, for example in a notch. The pivoting axis may nevertheless be concealed by a front bolster. Depending on the design of the handle body, the pivoting axis may enter the latter.

The liner block is usually comprised of two liners in the shape of generally rectangular plates, which extend parallelly, kept apart by one or several spacers. The liners may be in one piece or in several parts. The liner plates may e.g. be made from sheet metal, e.g. stainless steel.

In embodiments, the blade lock is a liner lock, one of the liners of the liner block including an elastic bar which takes up the storage space (between the liners) when the blade is in the active position, the free end of the elastic bar being positioned in abutment against the base of the blade in order to lock it in the active position.

In embodiments, the elastic bar of the liner lock has an outer face which has a protruding stop element, coming into abutment against the inside of the handle when the liner block is in a proximal position with the blade in the active position, and thus locking the elastic bar in the locking position. This stop element is preferably in abutment against the front edge of the handle when the elastic bar is in the inactive position (blade in the liner block).

Advantageously, the handle comprises a U-shaped body, with a bottom and two parallel wings, in which the liner block is slideable. The body of the handle may be an assembled part, but the use of a U-shaped profile is advantageous. The body of the handle may be made from any appropriate material, particularly metal (steel, titanium, alloys, etc.) or synthetic/plastic.

For guiding purposes, the free end of at least one of the U-shaped wings folds back inward so that it forms a guide edge. The two edges may be folded inward. Alternatively, one may use any means to ensure axial guidance of the liner block into the handle body, for example, a system of grooves and nut, or simply a screw laterally protruding on the liner block which engages into the groove in the corresponding wing of the handle body (or conversely a screw inside the handle going into a groove of the liner block).

In embodiments, the handle lock comprises a strip mounted in a wing of the handle body and carrying at its free end a lug capable of engaging into two notches along the liner block, corresponding to the distal and proximal positions.

Alternatively, the handle lock may be formed by the liner opposite to the one with the blade lock, a strip being cut in the plate or fixed separately. In this case, the notches (corresponding to the distal and proximal positions) are provided in the wing of the handle body to receive corresponding lugs extending from the strip.

In embodiments, the blade includes a step (or flat) at the base of its back, which, in proximal and active positions, goes into the bottom of the handle body, in abutment against it. This provides a locking point for the blade.

According to an embodiment, the knife is configured such that the knife is opened through an initial pivoting phase of the blade around its axis from the inactive position to the active position and locked by the blade lock, followed by a second phase of transferring by a linear translation the liner block from the distal position to the proximal position.

An elastic means, specifically a spring, may be connected between the liner block and the handle so as to exert a spring back force towards the proximal position of the liner block.

According to a further embodiment, the knife includes a lever capable of jointly driving the pivoting of the blade around its axis and the transfer of the liner block, with the lever being, seen in the active position of the blade, pivotably mounted on an end in the region of the blade base, back side, and the other end on the front section of the handle, on the side of the blade edge. The support point of this lever, enabling its rotation, is the head of the blade's pivoting axis.

In this embodiment, the handle lock includes a pivoting arm mounted on a wing of the handle body, working together with a notch on the liner block in which it can be engaged entirely when the blade is in active position, ensuring an additional locking of the blade and the liner block in the handle.

In a further embodiment, the lever driving the pivoting of the blade is connected to a moving part, connected to the handle by a spring, allowing an additional locking of the blade by the flat of his back.

In particular, the lever may be pivotably mounted at one end in the region of the blade base, back side, and at the other end on the moving part at the front of the handle, blade edge side, the moving part being slidably mounted relative to the handle. The moving part is elastically biased in proximal direction.

For example, the moving part may be reciprocally slidable on the side of the handle and linked to the handle body by means of a longitudinal slot. A screw is screwed in the handle and has its head engaged in the slot. A spring is attached at one end to the moving part and at the other end to the handle body.

The concept of the folding knife according to the invention is adaptable for a variety of knives, depending on the applications, the length of the blade can vary from 10 to 20 cm, or even more. For folding pocket knives, blades from 10 to 13 cm can be expected, with a handle of around 10 cm. For hunting or filleting knives, blades from 13 to 20 cm can be envisaged with a handle of around 13 cm. Larger sizes are possible. The present knife is thus adaptable to a variety of blade/handle combinations, the length of the blade exceeding that of the handle before being compensated by the length of the liner block away from the knife in the closed configuration.

BRIEF DESCRIPTION OF THE DRAWINGS

Other distinctive features and characteristics of the invention stand out in the detailed description of at least one advantageous embodiment presented below, for illustration purposes, in reference to the appended drawings. These show:

FIG. 2: a view of the knife from FIG. 1, blade back in;

DETAILED DESCRIPTION

Below, we will describe four alternative embodiments of the present knife, which employs an articulated assembly of three distinct elements: a blade, a liner block and a handle body. The blade pivots between the liners of the liner block, which is slidable in the handle. In the four alternative embodiments the knife blade is longer than the handle.

In the four embodiments, the knife may be opened by bringing the blade out of its inactive position through a rotation movement, which may be advantageously achieved with one hand, using a thumb stud or through inertia (wrist movement).

Below, we will use the terms "top", "bottom", "front", "back", "above" or "below" in reference to the positioning used in these figures; these terms may not be considered as restrictive.

Figure 1:
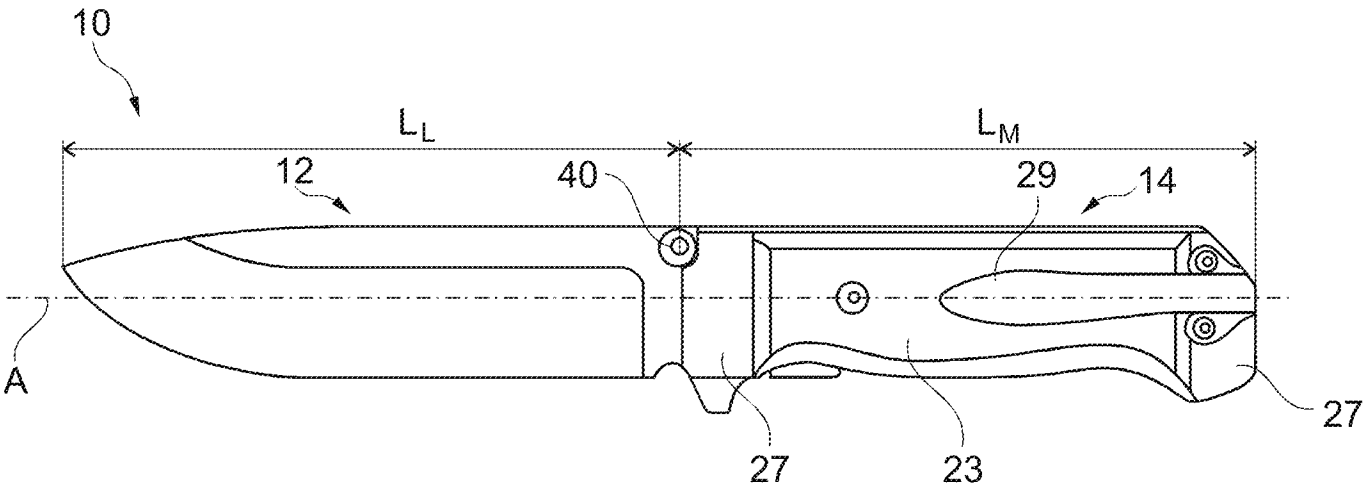
FIG. 1: a front view of a first embodiment of this folding knife, blade out.
Figure 5:
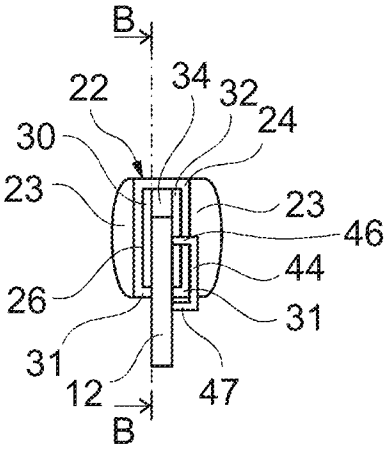
FIG. 5: a view from the left of FIG. 2.

In the longitudinal cross-sectional figures, the cross-section plane is parallel to the plane of the knife blade, and is located just above the blade when the knife is positioned as shown in FIG. 1—this cross-sectional plane is indicated B-B in FIG. 5.

A. First Embodiment

According to a first embodiment represented in FIGS. 1 to 11, the present folding knife 10 mainly includes a blade 12 and a handle 14 extending in a longitudinal direction A, the handle 14 comprising a liner block 16 which defines a storage space.

The blade 12 is pivoting hinged on the liner block 16 by means of a pivoting axis 18 through the base (or heel) 12.1 of the blade 12 and fixed on the liner block 16 so that the blade 12 can pivot between an inactive position, in which the blade 12 is received in the storage space in the liner block, and an active position, in which the blade 12 extends in line with the handle 14.

Figure 6:
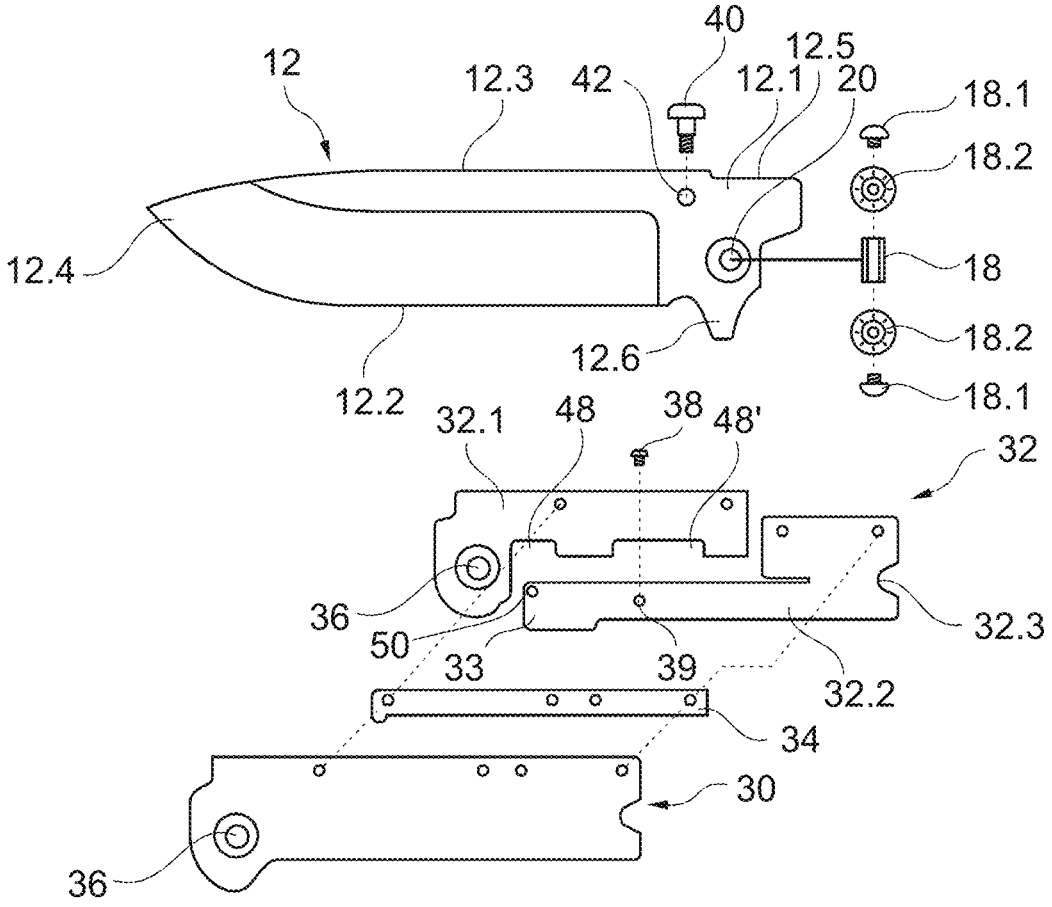
FIG. 6: an exploded view of the elements of the knife from FIG. 1.

The blade 12 is visible in isolation in FIG. 6 and formally presents a longitudinal cutting edge 12.2 or "edge", an opposite back 12.3, a point 12.4 and, across from this, the base/heel 12.1 which includes a hole 20 for the pivoting axis 18 on the liner block 16.

Figure 7:
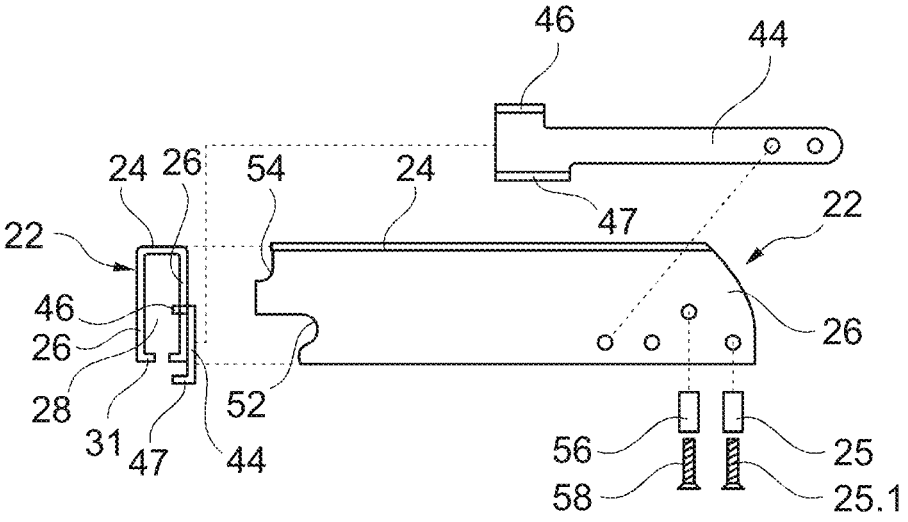
FIG. 7: a profile view of the handle body.

It will be noticed that the liner block 16 slides into the handle 14, substantially in the longitudinal direction A. For this purpose, the handle 14 includes a U-shaped handle body 22 comprised of a bottom 24 from which two wings 26 extend. The handle body 22 here is formed from a U-shaped profile, but may alternatively by manufactured through assembly. The handle body 22 may be made from metal or any other appropriate material. The cross-section of the U-shaped profile of the handle body 22 is illustrated in FIG. 7. The use of a U-shaped profile implies that the handle body 22 is open along the full length opposed to bottom 24. The handle body 22 forms a runner 28 which allows the liner block 16 to slide in axially.

The wings 26 preferably comprise edges 31 folded inwards for the axial guidance of the liner block 16.

Conventionally, the handle body 22 also supports on the outer faces of the wings 26 rectangular inlay plates 23, which may be made from any material, in particular wood, bone, metal, plastic or mixed.

Other not essential but current elements:

- an axis for lanyard 25 positioned at the back part of the knife through the two wings 26 of the handle body, and attached with a screw 25.1;
- bolsters 27 fixed to the front and back of the handle body and
- a pocket or belt clip 29 positioned on either side of the handle.

The liner block 16 also forms a U-shaped section. It is typically made up of two metal liners 30, 32, generally rectangular and parallel, joined by a longitudinal edge through a spacer 34 (rectangular section metal bar) such as to define the storage space for the blade. In further embodiments, there may be several spacers. It is not necessary for the spacer to extend continuously along the edge. Each liner 30, 32 is equipped with a hole 36 for the blade axis 18 to pass through. The holes 36 are positioned lengthways towards the end of the liners, in the so-called "front" area of the liner block 16 (on the left in FIG. 1 or 6), with regards to the "back" area which does not come out of the handle body. Axis 18 here is held by two screws 18.1 leaning against the outer faces of the liners. The blade 12 and the liners 30 and 32 include on their faces opposite to each other counterbores centred on the pivoting axis, to receive ball bearings 18.2 (optional).

As can be seen in FIG. 6, in this embodiment, one of the liners 32 is made up of two parts in complementary shapes: a base 32.1 and an elastic bar 32.2 (or elastic strip). The different pieces of the liner blocks 16 are joined via the spacer 34, by screws or any other appropriate means.

The elastic bar 32.2 here makes up the blade lock and is designed to form a so-called "liner lock". Classically, the elastic bar 32.2 has a slightly curved/arched shape when at rest. When the blade 12 is in the inactive position, the elastic bar 32.2 is therefore kept flat by the blade 12 in the inactive position, and spontaneously bends in the storage space when the blade is deployed, the free end of the elastic bar 32.2 coming into position behind the heel. The bar 32.2 comprises a tab 33 which protrudes with regard to edge of the bar 32.2, away from the storage space, to manually bring the bar 32.2 back into the plane of the liner 32. Alternative embodiments for the liner block 16 may be devised by those skilled in the art. The liner 32 with the elastic bar 32.2 may be, for example, in one piece, with the bar cut into a rectangular plate such as liner 30.

In FIG. 6, one will notice a stop element 38 positioned towards free end of the elastic bar 32.2. This stop element 38 may take the form of a screw threaded into a corresponding hole 39 of the elastic bar 32.2. The screw head therefore protrudes of an outer surface of the elastic bar 32.2.

Reference sign 40 designates a thumb stud fixed on the blade, for example by screwing in a threaded hole 42.

Still on FIG. 6, reference sign 44 designates an elastic strip forming a handle lock, which is attached using a pair of screws at one end of the handle body 22, preferably on the outer face of a wing 26. The free end of the handle lock 44 has a lug 46 extending perpendicularly to the plane of the strip 44, and which cooperates with notches 48, 48' provided in liner 32. Opposite the lug 46, there is a tab 47 to manoeuvre strip 44.

Description of Functioning

Figure 2:
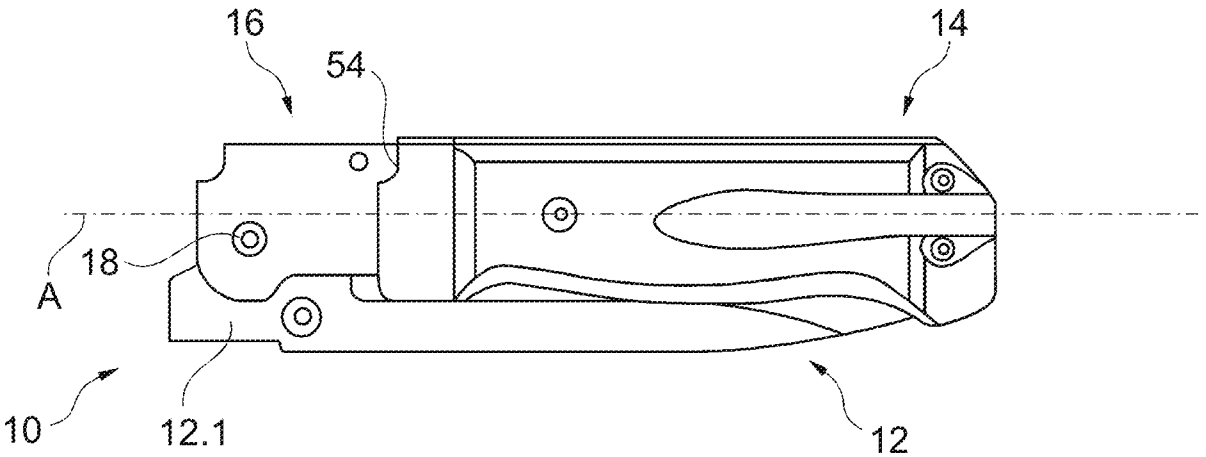
Figure 3:
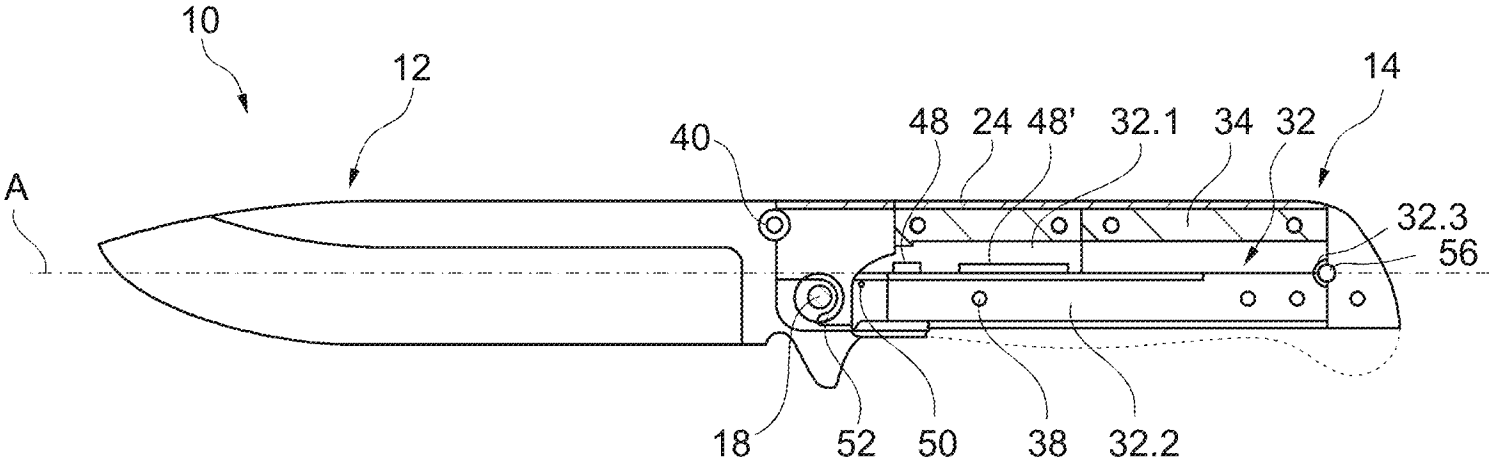
FIG. 3: a longitudinal cross-sectional view through the handle of the knife from FIG. 1.
Figure 4:
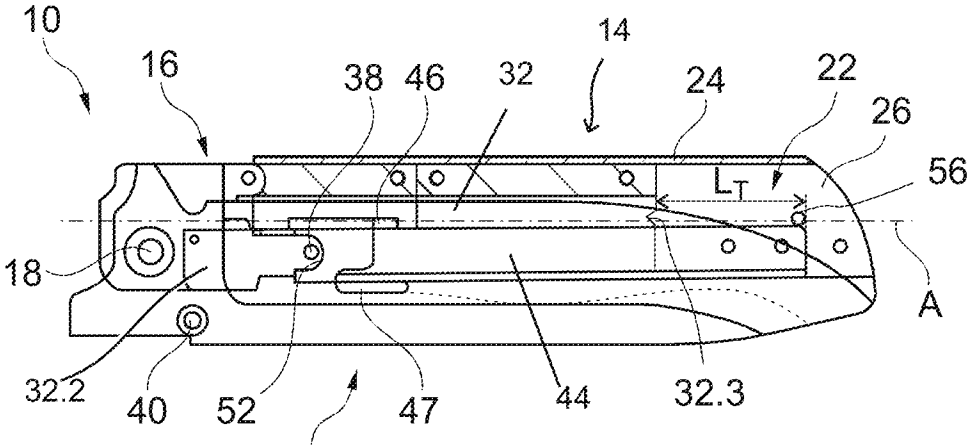
FIG. 4: a longitudinal cross-sectional view through the handle of the knife from FIG. 2.

Both main configurations of the knife 10 are represented in FIGS. 1 and 2, to which FIGS. 3 and 4 correspond and which illustrate the main internal functioning.

FIG. 1 shows the knife as "open", blade 12 deployed and ready to use: the blade 12 is therefore in the active position, and is locked by the blade lock 32.2. As we can clearly see, the visible length of blade $L_L$ is longer than that of the handle $L_M$.

In FIG. 2, the knife is "closed" and the blade 12 is in the inactive position in the handle 14. The left side of the handle, the side from where the blade is deployed, is called the front, and the opposite side therefore constitutes the back.

We will notice that in the closed knife configuration, the edge of the blade 12.2 is completely concealed, even though the blade 12 is longer than the handle 14. This is made possible thanks to the construction of the handle 12 which includes the sliding liner block 16.

As we can clearly see in FIGS. 3 and 4, when the configuration of the knife goes from open to closed, and vice versa, this entails movement of the liner block 16 with regards to the handle body 22.

Knife open, the liner block 16 essentially goes back into the handle 14. The back edge of the liner block 16 is in abutment against a so-called backlash removal axis 56 (held by a screw 58) in the back part of the handle body 22. For that, each liner comprises a notch 32.3 which is used along axis 56. This is the proximal position of the liner block 16.

In FIG. 4 which corresponds to the closed knife, we see the liner block 16 has been moved along a length $L_T$ in the longitudinal direction A, to the extent that the front part of the liner block is at a distance from the front edge of the handle 14, respectively of the handle body 22. This is the distal position of the liner block 16. This shift away from the handle (towards the left in the figure) allows a space to appear with a length $L_T$ corresponding to the inside of the handle body 22 (to the right of the liner block 16 in the figure) which is used to store the blade 12.

When blade 12 is in the inactive position, it is received in the storage space of the liner block 16 and in the additional storage space inside the handle when the liner block 16 is in the distal position. From the pivot 18, the blade 12 is therefore brought into the handle 14 along its full length, partly in the liner block 16 and for the end section in the back of the handle body 22.

Opening of the knife 10 will now be described in detail. We can break the opening manoeuvre down into four phases which occur one after the other under the action of the thumb stud 40, manoeuvred in a single movement.

The initial configuration is with a closed knife, FIG. 2. The blade 12 retracts into the handle 14, held, in the classic manner, by a detent ball 50 provided on the blade lock 32.2.

The liner block 16, partially away from the handle 14, is held by the stop element 38 of the blade lock 32.2., stopped against the handle body 22 and through the lug 46 of the handle 44 engaged in the back groove 48' of liner plate 32.

Phase 1. Pivoting Blade—FIG. 8

Figure 8:
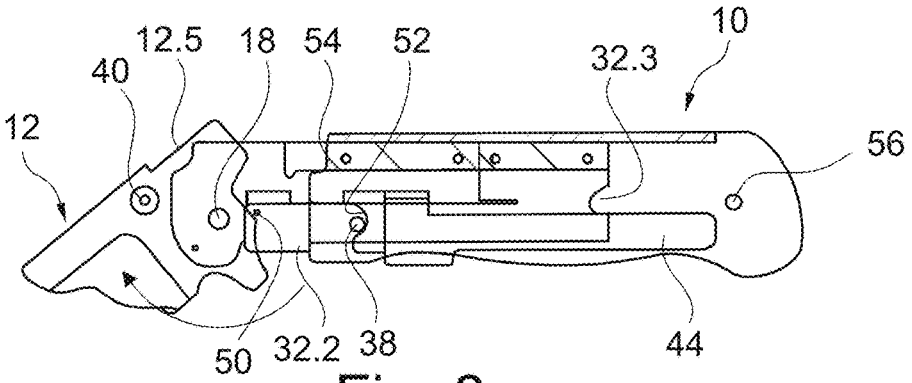
FIG. 8: a front view of the knife from FIG. 1, blade partially out.
Figure 9:
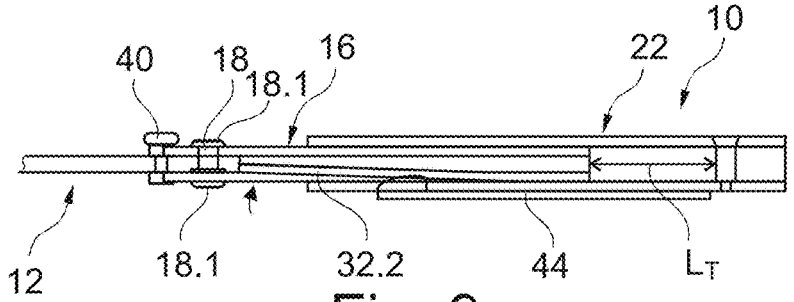
FIG. 9: an underside view of the knife from FIG. 1, blade in the active position and locked by the blade lock.
Figure 10:
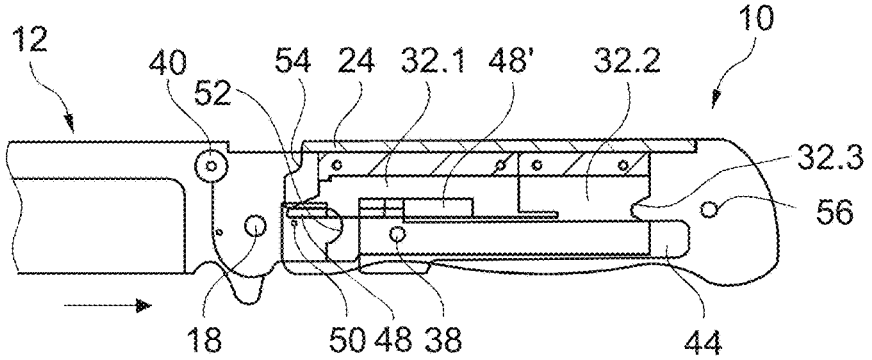
FIG. 10: a front view of the knife from FIG. 1, the liner block partially back inside the handle body.

The blade 12 is released from the detent ball 50 by pushing the thumb stud 40, which makes it pivot around its axis 18 in the direction of the arrow in FIG. 8.

We will notice that the blade 12 pivots away from the handle 14 directly from the inactive/closed position. The handle 14/handle body 22 does not hinder its movement, and it is therefore sufficient to overcome the relatively weak force of the detent ball 50.

During this pivoting phase, the liner block 16 is locked translationally by means of the stop element 38 of the blade lock 32.2, the stop element 38 being stopped at the bottom of a cut 52 on the front edge of the handle body 22. We will notice that the handle body 22 has a cut 52 in each wing 26, arranged in a symmetrical manner to receive the head 18.1 of the pivot 18.

Phase 2. Blade Locking by the Liner Lock—FIG. 9

After pivoting around 180°, the blade 12 arrives in the end position in line with the handle (aligned with axis A). This releases the blade lock 32.2 which classically is engaged behind the heel 12.1 of the blade, as indicated by the arrow in FIG. 9. The blade 12 is locked in this position with regards to the liner block 16; this is the active position of the blade.

At this stage, the liner block 16 has not moved with regards to FIG. 8.

Phase 3. Transfer of the Liner Block—FIG. 10

The stop element 38 integrated in the blade lock 32.2 is released from its notch 52 against the handle body 22 during phase 2 and therefore releases the liner block 16 which can slide into the handle, under the continuous action on the thumb stud 40. To do this, the lug 46 of the handle lock 44 is released from the back groove 48'. This is enabled by the quarter round shape of the lug (cf. FIG. 11), therefore including a part which curves towards the front, finishing in the back with a straight part perpendicular to the arm 44, which acts as a stop in the notches 48 and 48'.

Phase 4. Locking of the Liner Block by the Handle Lock—FIG. 11

Figure 11:
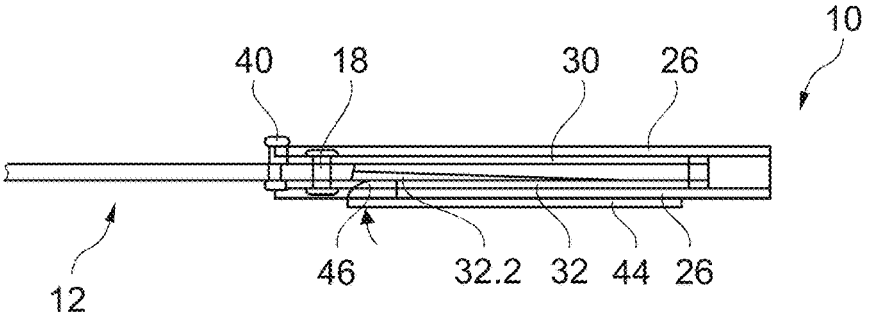
FIG. 11: an underside view corresponding to the open knife of FIG. 1.

At the end, the liner block 16 has completely returned into the handle 14 and locked by the lug 46 of the handle lock 44 which engages into the front groove 48 of the liner 32, as illustrated by the arrow in FIG. 11. The knife 10 is then in the open configuration of FIG. 1, ready to be used.

We will see that in the knife's open position, the blade 12 is triply locked:

- above its axis 18, through the handle body 22. In effect, at the base 12.1 of the blade, the back 12.3 comprises a step 12.5 (or plane) which extends, blade deployed, in accordance with axis A and is received under and against the bottom 24 of the handle body 22. The step 12.5 is stopped against the bottom 24 and the blade therefore cannot pivot around the axis 18.
- behind its heel 12.1, through the blade lock 32.2. (classic liner lock)
- through the stop element 38 which intervenes between the handle body 22 and the blade lock 32.2, by immobilising this lock. In effect, in the open configuration, the liner block 16 goes from the distal to the proximal position, allowing the recoil of the liner block 16 into the handle 14 inserting the stop element 38 against the inner face of the wing 26 of the handle body 22. It is not possible to release the blade lock 32.2 from the heel 12.1.

The blade/liner block system is also joined with the handle:

- by the thumb stud 40 engaged in a cut 54 corresponding to the front edge of the handle body 22;
- by the screw heads 18.1. of the blade pivot 18 engaged in the respective cuts 52 of the handle body 22;
- and by the backlash removal axis 56 engaged into the liner plate notches 32.3.

Handling

We can summarise the handling of the folding knife 10 as follows:

Opening:

- action on the thumb stud 40, or movement of the wrist initiating the opening through inertia.

Closure:

- action of the thumb on the end 12.6 of the blade heel (together with the bottom of the liner block), pushed forward, this movement clearing before the handle lock 44
- then, classically, joint action of the thumb to release the blade lock 32.2 and the index finger to fold away the blade 12

Disassembly (Partial for Cleaning):

- knife open, held off the handle lock 44 allowing the liner block 16 to be released from the handle 14. Note that this is done without tools.

Reassembly:

- insertion of the liner block 16 into the handle 14 until locked by the handle lock 44.

B. Second Embodiment

Figure 12:
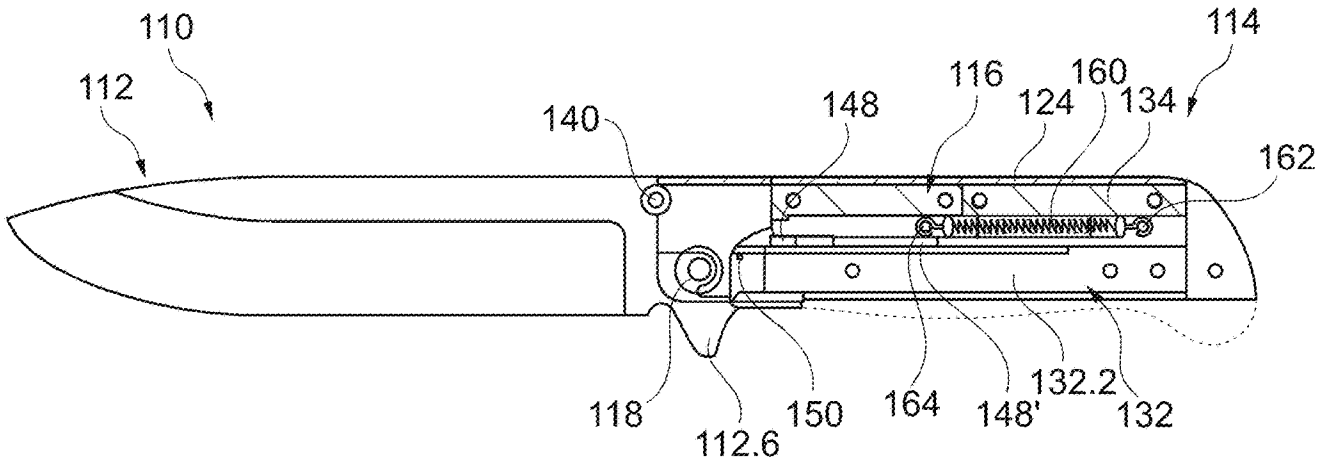
FIG. 12: a longitudinal cross-sectional view through the handle of a second embodiment of this knife, open configuration.
Figure 13:
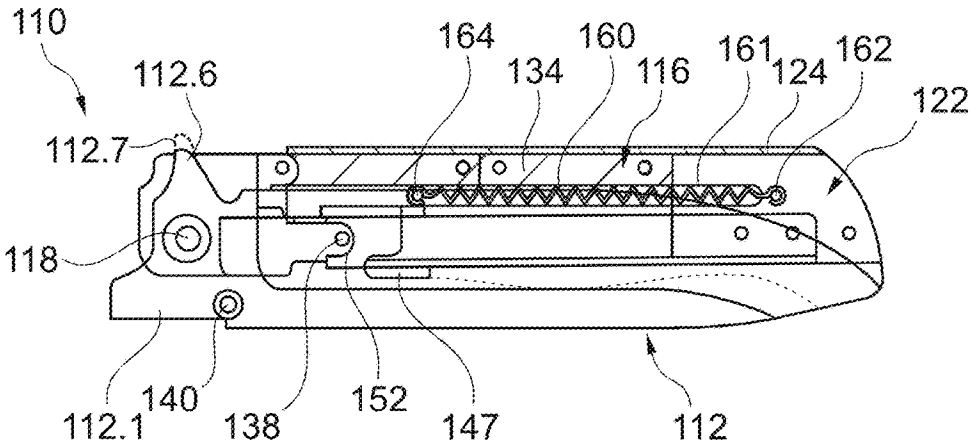
FIG. 13: a longitudinal cross-sectional view through the handle of the second embodiment of this knife, closed configuration.

The second embodiment, illustrated in FIGS. 12 and 13, is related to a modification of the knife in FIG. 1 whose opening is assisted here by a spring.

The identical or similar elements are identified by the same reference signs, increased by 100.

The components are essentially the same as for the first embodiment, and we will therefore only describe the changes introduced for this second alternative variation.

The outer aspect of the folding knife 110 does not change and is therefore identical to that in FIGS. 1 and 2.

We will notice that there is an assistance spring 160 present which is positioned, for example, laterally in a longitudinal light 161 built into the handle body 122 and which is joined at one end to the handle body 122 and to the other at the liner block 116. The spring 160 has hooked ends and is mounted in a screw head 162 which is engaged in the handle body 122 and to the other side to a screw head 164 entered into the liner plate 130. The spring could also be positioned inside the handle, behind the (shortened) spacer.

With the knife closed, the spring 160 is under tension (FIG. 13). During opening, the liner block 116 is brought back to the bottom of the handle 114 by sliding into the handle body 122, taking the configuration from FIG. 12.

On the whole, the functionalities of the folding knife 110 are identical to those of the first embodiment, except for the opening phase 3 which is assisted through use of the traction spring 160. Manual opening of the knife 110 is always possible, but opening through inertia resembles automatic opening.

With an alternative procedure, if automatic opening is favoured by the user, the model may be lightly changed to allow a "flipper" action rather than through the thumb stud. In this case, the blade heel is drawn causing it to stick out (112.7 in dotted lines on the figure), transversally sticking out (with regards to axis A) from the liner block, knife closed. It is the thumb stud 140 which subsequently serves as a stop for the blade 112 in the open position, rather than the spacer 134 as this is shortened to allow rotation of the flipper.

Handling

Opening:

- action on the thumb stud 140, or on the flipper 112.7 (or movement of the wrist initiating the opening through inertia)

Closure:

- action of the thumb on the end 112.6 of the blade heel (together with the bottom of the liner block), pushed forward, this movement clearing before the handle lock 144
- classic joint action of the thumb to release the blade lock 132.2 and the index finger to fold away the blade 112.

Disassembly (Partial for Cleaning):

- the screw 164 connecting the assistance spring 160 to the liner block 116 must be removed, following disassembly of the corresponding inlay plate. Next, knife open, held off the handle lock 144 by its tab 147 allows the liner block 116 to be released from the handle 114.

Reassembly:

- insert the liner block 116 into the handle 114 until it is locked by the lock 144 and put back in place the screw 164, connecting the liner block 116 to the assistance spring 160. Reassembly of the inlay plate.

C. Third Embodiment

The third embodiment, illustrated in FIGS. 14 to 19, is related to a modification of the knife in FIG. 1 whose opening is assisted here by a lever.

The identical or similar elements are identified by the same reference signs, increased by 200.

The components are essentially the same as for the first embodiment, and we will therefore only describe the changes introduced for this third alternative variation.

This embodiment differs from the first because it uses a lever 270 hinged between the thumb stud 240 axis and an axis 272 placed on the front of the handle. Specifically but not necessarily, axis 272 is fixed to a front bolster 227 of the handle body 222. This lever 270 pivots around the screw head 218.1 of the pivoting blade axis 218. It allows the simultaneous opening of the blade 212 of the knife 210 and the return of the liner block 216 into the handle 214.

The lever 270 may be simple, as described, or split on both sides of the blade. Extending its dimensions, this lever may also serve as a (upper and lower) guard for the knife.

In addition, the blade 212 has, at its heel 212.1, a rounded outer edge 212.5 (curved in towards the axis 218) instead of a flat step, this rounded profile above the axis 218 allows pivoting in the handle without stopping against the bottom 224 of the handle body 222. The knife 210 no longer has a stop element on the liner or notches for handle lock, nor handle lock as previously described.

On the other hand, an additional lock is envisaged to lock the liner block 216 in the handle, the blade 212 being in active position. It includes an arm 274 which has one end fixed pivoting to the handle body 222 and the other end has a lug 276 which cooperates, in the active position, with a notch 278 in the liner plate 232. As we can see in FIG. 16B, the lug 276 is perpendicularly folded away into the plane of the arm 274. It extends in the direction of the liner block 216 and includes a base 276.1 which stops, when the lock 274 is in the active position, against the elastic bar 232.2, thus ensuring a locking in the transversal direction. A front part 276.2 of the lug goes into the notch 278 of the blade 232.2, ensuring an axial locking preventing movement of the liner block 216. The arm 274 also includes a tab 275 folding in towards the outside to manoeuvre this lock.

In this embodiment, the handle lock may also serve as safety lock, by providing a second notch in the liner plate, which cooperates, in the inactive position, with the lug 276. In this case, the handle lock must be disengaged before opening the knife (not illustrated).

Otherwise, this type of handle lock may be used in the other embodiments.

Figure 15:
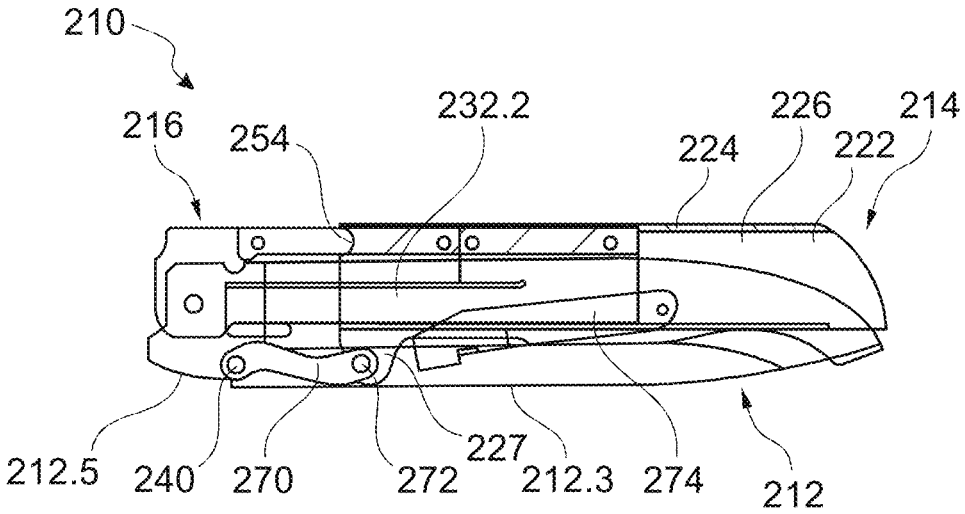
FIG. 15: a longitudinal cross-sectional view through the handle of the third embodiment of this knife, closed configuration.
Figure 16A:
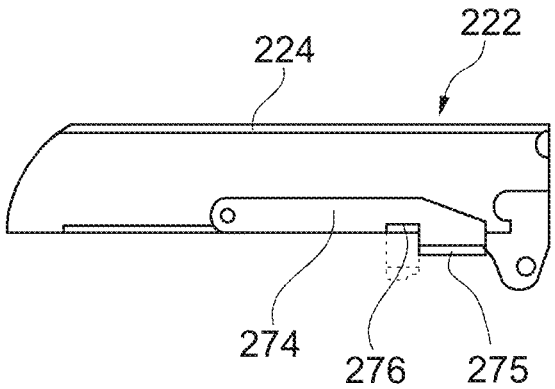
FIG. 16A: a longitudinal cross-sectional view of the body of the handle of FIG. 15.
Figure 16B:
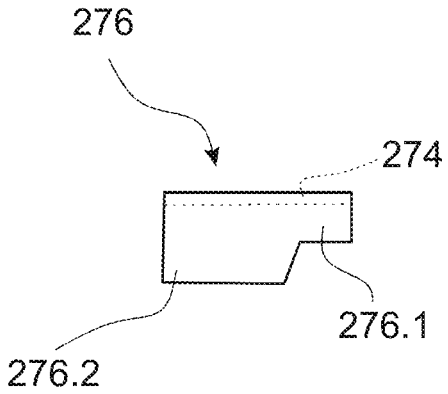
FIG. 16B: a detailed view of the safety lock's lug.

1. Closed Knife (FIG. 15)

The blade 212 is folded in towards the handle 214, held by the detent ball 250 of the blade lock 232.2

The liner block 216, partially away from the handle 214, is held in this position by the lever 270 for assisted opening.

Figure 17:
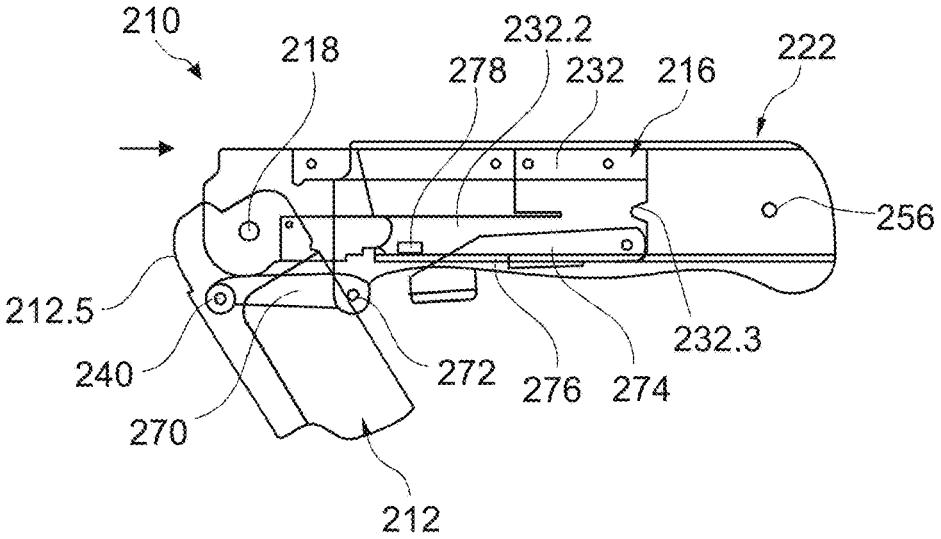
FIG. 17: a front view of the knife from FIG. 14, blade partially out.

2. Opening (FIG. 17)

Opening the knife 210 begins using an action on the end of the liner block 216 (or movement of the wrist for opening using inertia). The recoil of the liner block 216 into the handle 214 entails rotation of the blade 212 through intervention of the lever 270. The fixation points of the lever 270 are positioned so that from a certain angle of rotation of the blade 212, the lever 270 leans on the head 218.1 of the pivot axis 218 of the blade. In the end position, the blade 212 is locked by the blade lock 232.2 (first locking). Gripping the handle 214, the index finger closes on the tab 275, pivots the arm 274 in the direction of the handle, this arm being only held by friction (but could also be associated with a spring). The lug 276 goes into the corresponding notch 278, here located on an outer edge of the liner lock 232.2 (FIGS. 18 and 19), on one hand stopping this lock 232.2 from leaving its position (2nd locking) and on the other hand locking the whole blade/liner block in the handle 214 (3rd locking).

Figure 14:
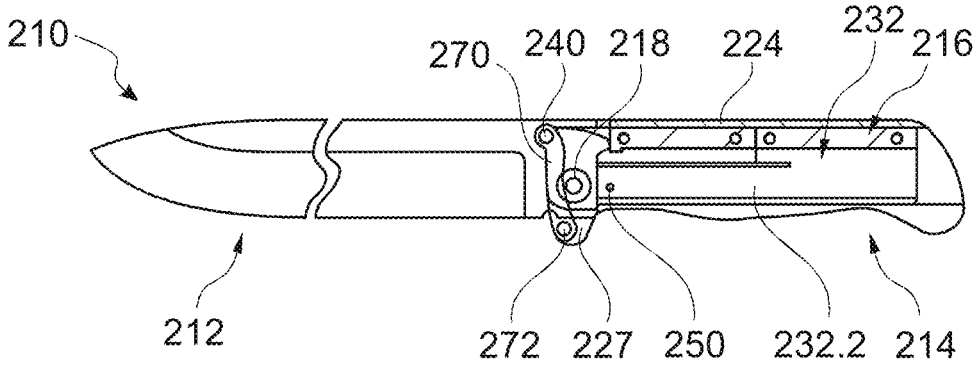
FIG. 14: a longitudinal cross-sectional view through the handle of a third embodiment of this knife, open configuration.
Figure 18:
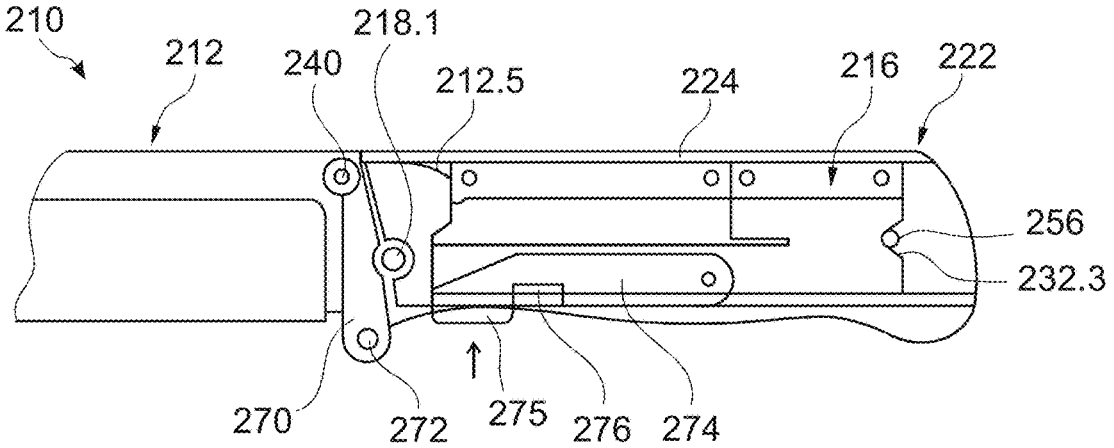
FIG. 18: an enlarged view of FIG. 14.
Figure 19:
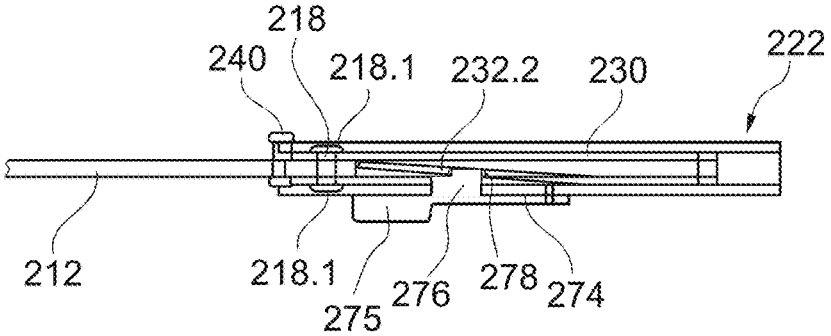
FIG. 19: an underside view of FIG. 18.

3. Open Knife (FIGS. 14, 18 and 19)

The blade 212 is locked in the open position by the blade lock 232.2. This lock is itself immobilised by the handle lock 274.

The blade/liner block system is also joined with the handle:

- by the thumb stud 240 axis engaged in the cut 254 corresponding to the handle body;
- by the axis 272 connecting the other end of the lever 270 to the handle body, via the bolster 227;
- by the axis 218 of the blade pivot whose screw heads 218.1 go into the cuts of the handle body 252;
- by the backlash removal axis 256 engaged in the back notches of the liner plates;
- by the lug 276 of the locking safety 274 engaged in the notch 278 of the blade lock 232.2.

Handling

Opening:

- action of the index finger on the end of the liner block 216 (or opening using inertia)

Gripping the handle 214 actuates the handle lock 274

Closure:

- unlocking of the handle lock 274 using the middle finger by pushing the tab 275
- joint action of the thumb to release the blade lock 232.2 and the index finger to fold away the blade 212

Disassembly (Partial for Cleaning):

- unscrew the thumb stud 240 (without a tool as it is grooved), releasing the lever and allowing the liner block 216 to be removed from the handle.

Reassembly:

- insertion of the liner block into the handle
- tightening the thumb stud 240.

D. Fourth Embodiment

Figure 20:
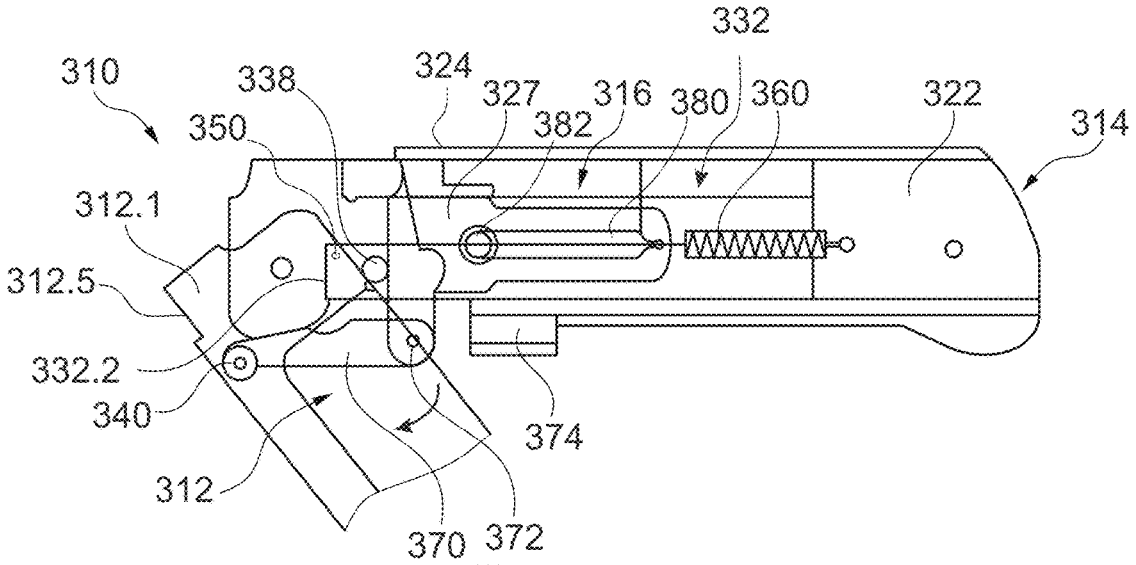
FIG. 20: a longitudinal cross-sectional view through the handle of a fourth embodiment of this knife, partly open.
Figure 21:
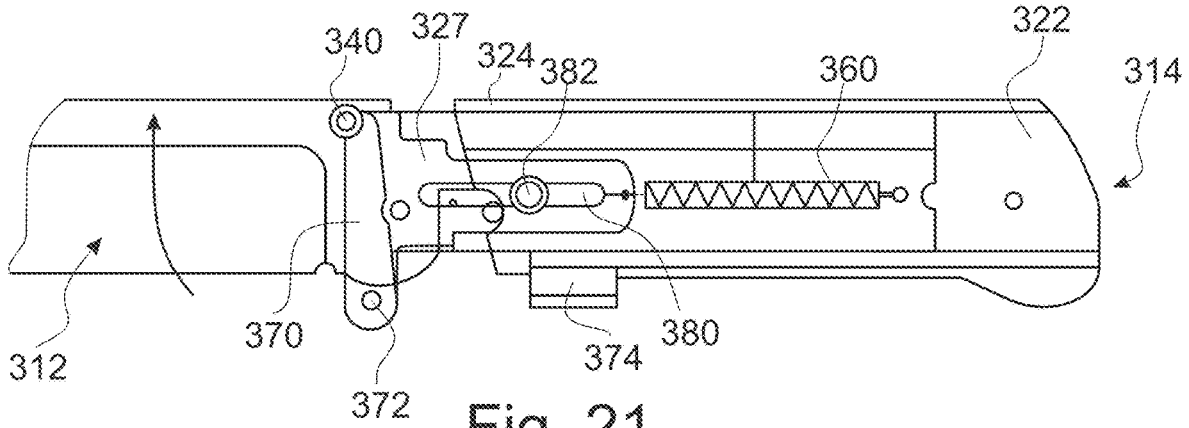
FIG. 21: a longitudinal cross-sectional view of the knife of FIG. 20, with the blade aligned but in intermediate position.
Figure 22:
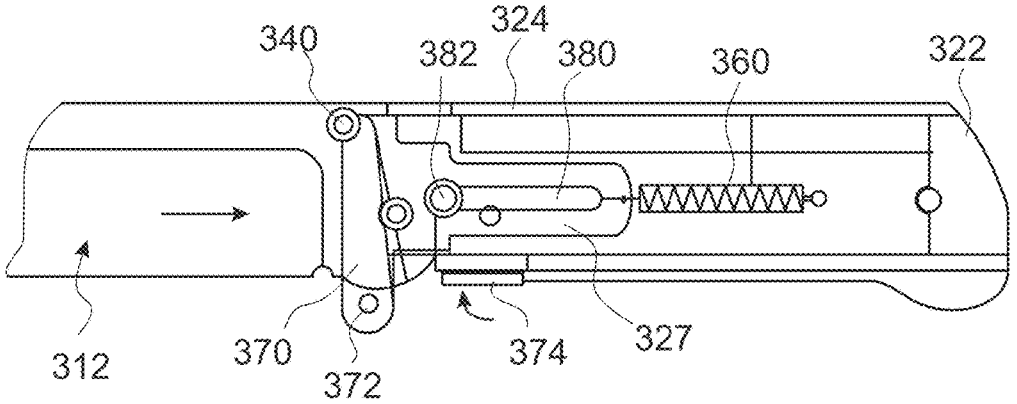
FIG. 22: a longitudinal cross-sectional view of the knife of FIG. 20 in open configuration.

The fourth embodiment, illustrated in FIGS. 20 to 22, relates to a modification of the knife of FIG. 1, whose opening is assisted here by a lever and a spring.

Identical or similar elements are identified by the same reference signs, increased by 300.

The components are essentially the same as for the first embodiment, and we will therefore only describe the changes introduced for this fourth embodiment.

This embodiment also employs a lever 370 articulated by way of the axis of the thumb button 340 and an axis 372 that is mounted on a moving part 327, and hence not directly to the handle body 322 (as in the third variant). The moving part 327 is reciprocally slidable on the side of the handle and, for example, linked to the handle body 322 by means of a longitudinal slot 380, a screw 382 being fixed in the handle and having its head engaged in slot 380. A spring 360 is attached at one end to the moving part 327 and at the other end to the handle body 322.

Similar to the first and second embodiments, blade 312 comprises at its heel 312.1 a step 312.5 (or plane). The knife 310 comprises a protruding stop element 338 mounted on the blade lock 332.2 (elastic bar of the liner block). The safety lock 374 for the liner block is similar to that of the third embodiment.

1. Closed Knife

The blade 312 is folded in the handle 314, held by the detent ball 350 of the blade lock 332.2.

The liner block 316, partially outside of the handle 314, is held in this position by the lever 370 for assisted opening.

2. Opening (FIGS. 20 and 21)

Opening the knife 310 begins by acting on the end of the liner block 316 (or movement of the wrist for opening using inertia), which causes the blade to pivot. At the end of the opening the lever 370 leads the moving part 327 to the front, the handle body 322 being held in place by the stop element 338 of the blade lock 332.2. The stop element is in abutment against the front edge of the handle body 322.

When the blade reaches the active position, the blade lock 332.2 folds into position behind the blade heel, locking the blade and moving away stop element 338. This is the configuration of FIG. 21. The spring 360 is fully extended.

Since the stop element 338 has withdrawn from engagement with the edge of the handle body 322, spring 360 then causes the moving part 327 to move back into initial position of FIG. 20. The liner block 316 and the blade, which are linked to the moving part 327 through lever 370 slide in the handle and become locked by acting on the handle lock 374.

3. Open Knife

In active and proximal positions the blade is locked in the handle:

by the step 312.5 in the blade heel, positioned against the base 324 of the U profile. Depending on the design stroke for the moving part 327, the step 312.5 in the heel can be either partly or fully engaged under the U-shaped profile 322 of the handle. When partly engaged, a notch is provided at the front end of the base 324 of the U profile 322 to allow rotation of the blade heel.

by the blade lock 332.2 engaged behind the blade heel (classic liner lock).

by the stop element 338 on the blade lock 332.2 inserted between the side of the U-shaped profile and the blade lock, blocking the latter in its folded position.

by the handle lock 374, rigidly uniting handle, liner block and blade lock.

The blade and liner lock assembly are also united with the handle as in the third embodiment.

Handling:

The handling (opening, closing, partial disassembly) is similar to the third embodiment, except for the closing, where the user will first, with his thumb, push forward the blade heel (unitary with the liner block) to disengage the step 312.5, and then remove the blade lock 332.2. In practice, both moves (forward pushing and disengaging the blade lock) are carried out concurrently, through a single movement.

As compared to the third embodiment (opening by lever only), the knife 310 has an additional and efficient locking point for the blade by way of its step 312.5.

As compared to the second embodiment (spring assisted opening), the spring 360 connecting the moving part 327 and the handle body 322 is only shortly under tension during the opening and closing phases.

The invention claimed is:

1. A folding knife comprising:

a handle including a liner block, the handle extending in a longitudinal direction and the liner block comprising two parallel liners defining a storage space between them;

a blade pivotably mounted on the liner block by means of a pivoting axis through a base of the blade and mounted on the liner block so that the blade can pivot between an inactive position, where the blade is received in the storage space in the liner block, and an active position, where the blade extends in line with the handle;

a blade lock capable of locking the blade in the active position;

wherein the liner block is mounted in the handle to be slideable substantially in the longitudinal direction, between;

a distal position, wherein the liner block is partially transferred away from the handle, thus freeing up a space of corresponding length in the handle to accommodate the knife's blade when the knife is closed;

a proximal position, corresponding to an open configuration of the folding knife with the blade in the active position and locked by the blade lock, where the front section of the liner block is in a proximal position to the handle, taking up the free space in the distal position; and in that a handle lock is provided to lock the liner block with regards to the handle in the proximal position.

2. The folding knife according to claim 1, wherein in the closed knife configuration, with the blade in the inactive position, the liner block is in the distal position and the blade is received in the liner block and in the free space in the handle.

3. The folding knife according to claim 1, wherein the blade has a length greater or equal to that of the handle.

4. The folding knife according to claim 1, wherein in the closed knife configuration the pivoting axis is outside the handle.

5. The folding knife according to claim 1, wherein in the proximal position, the pivoting axis is stopped against the handle.

6. The folding knife according to claim 1, wherein the blade lock is a liner lock, one of the liners of the liner block comprising an elastic bar which occupies the storage space whilst the blade is in the active position, the free end of the elastic bar being positioned in a stop position against the base of the blade in order to lock it in the active position.

7. The folding knife according to claim 6, wherein the elastic bar has an outer face which has a protruding stop element, coming into abutment against the inside of the handle, whilst the liner block is in the proximal position with the blade in the active position, and thus blocking the elastic bar in the locked position.

8. The folding knife according to claim 7, wherein in inactive position of the elastic bar, the stop element is in abutment against the front edge of the handle.

9. The folding knife according to claim 1, wherein the handle has a body in the shape of a U, including a bottom and two parallel wings, in which the liner block is slideable.

10. The folding knife according to claim 9, wherein the handle lock comprises a strip attached to a wing of the handle body and with a lug at its free end capable of engaging into two notches spaced axially on the liner block, corresponding to the distal and proximal positions.

11. The folding knife according to claim 9, wherein the handle lock comprises a strip extending from the liner opposite the one with the elastic bar forming the blade lock, the strip comprising a pair of lugs that cooperate with notches provided in the wing of the handle body, corresponding to the distal and proximal positions.

12. The folding knife according to claim 1, wherein the blade has a step at the base of its back, which, in proximal and active positions, is placed under the bottom of the body of the handle, in abutment against it.

13. The folding knife according to claim 1, wherein the knife is configured such that opening the knife occurs through a first phase of pivoting the blade around its axis from the inactive position to the active position and blocked by the blade lock, followed by a second phase of transferring the liner block from the distal position to the proximal position and blocked by the handle lock.

14. The folding knife according to claim 1, wherein an elastic means of spring-back, is connected between the liner block and the handle to create a spring force towards the proximal position of the liner block.

15. The folding knife according to claim 1, wherein the knife has a lever capable of jointly driving the pivoting of the blade around its axis and the transfer of the liner block, with the lever being, seen in the active position of the blade, pivotably mounted at one an end in the region of the blade base, back side, and at the other end on the front section of the handle, on the edge side.

16. The folding knife according to claim 15, wherein, at the end of the rotation, the lever leans on the head of the pivoting axis.

17. The folding knife according to claim 15, wherein the handle has a body in the shape of a U, including a bottom and two parallel wings, in which the liner block is slideable, and wherein the handle lock has a pivoting arm mounted on a wing of the handle body, said arm has a lug working together with a notch on the liner block in which it can fully engage in the active position of the blade, said lug being configured to transversally block the blade lock and axially the liner block on the handle.

18. The folding knife according to claim 17, wherein the handle lock further serves as safety lock, a second notch being provided on the liner block, which cooperates with the lug in the inactive position of the blade.

19. The folding knife according to claim 1, comprising a lever pivotably mounted at one end in the region of the blade base, back side, and at the other end on a moving part at the front of the handle, blade edge side, the moving part being slideably mounted on the handle; and said moving part being elastically biased in proximal direction.

20. The folding knife according to claim 19, wherein the moving part is reciprocally slideable on the side of the handle and linked to the handle body by means of a longitudinal slot;

a screw is fixed in the handle and has its head engaged in said slot; and a spring is attached at one end to said moving part and at the other end to said handle body.

* * * * *